US009865149B1

(12) United States Patent
Pence

(10) Patent No.: US 9,865,149 B1
(45) Date of Patent: Jan. 9, 2018

(54) FINGERPRINT READER CHILD TRACKING SYSTEM

(71) Applicant: Amanda Pence, Humble, TX (US)

(72) Inventor: Amanda Pence, Humble, TX (US)

( * ) Notice: Subject to any disclaimer, the term of this patent is extended or adjusted under 35 U.S.C. 154(b) by 0 days.

(21) Appl. No.: 15/182,764

(22) Filed: Jun. 15, 2016

(51) Int. Cl.
*G08B 21/00* (2006.01)
*G08B 21/02* (2006.01)

(52) U.S. Cl.
CPC ..... *G08B 21/0261* (2013.01); *G08B 21/0288* (2013.01)

(58) Field of Classification Search
CPC ..... G08B 21/0261; G08B 21/0288
USPC ..... 340/539.13
See application file for complete search history.

(56) References Cited

U.S. PATENT DOCUMENTS 5,900,817 A 5/1999 Olmassakian
6,169,494 B1 1/2001 Lopes
6,278,370 B1 8/2001 Undewood
D453,698 S 2/2002 Marks
6,362,778 B2 3/2002 Ncher
7,259,671 B2 8/2007 Ganley et al.
8,027,662 B1 * 9/2011 Miller ..... H04L 67/18 455/17
2003/0218539 A1 11/2003 Hight
2004/0198382 A1 10/2004 Wong
2005/0020274 A1 1/2005 Orsini
2014/0004828 A1 * 1/2014 Han ..... H04W 64/00 455/411
2015/0035672 A1 2/2015 Housley et al.
2016/0042628 A1 * 2/2016 Roston ..... G08B 21/0261 340/573.1

* cited by examiner

*Primary Examiner* — Mark Rushing

(57) ABSTRACT

A child tracking system includes an electronic device that may be manipulated. A pair of tracking units is provided. Each of the tracking units may be worn by an associated one of an adult and a child. Each of the tracking units may be in communication with a global positioning satellite. Thus, a physical location corresponding to each of the tracking units may be identified. Each of the tracking units is in electrical communication with the electronic device. Thus, the electronic device may display the physical location corresponding to each of the tracking units. Each of the tracking units has a fingerprint reader to read fingerprints.

1 Claim, 3 Drawing Sheets

FINGERPRINT READER CHILD TRACKING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to tracking devices and more particularly pertains to a new tracking device for tracking a child in a public area.

BRIEF SUMMARY OF THE INVENTION

An embodiment of the disclosure meets the needs presented above by generally comprising an electronic device that may be manipulated. A pair of tracking units is provided. Each of the tracking units may be worn by an associated one of an adult and a child. Each of the tracking units may be in communication with a global positioning satellite. Thus, a physical location corresponding to each of the tracking units may be identified. Each of the tracking units is in electrical communication with the electronic device. Thus, the electronic device may display the physical location corresponding to each of the tracking units. Each of the tracking units has a fingerprint reader to read fingerprints.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
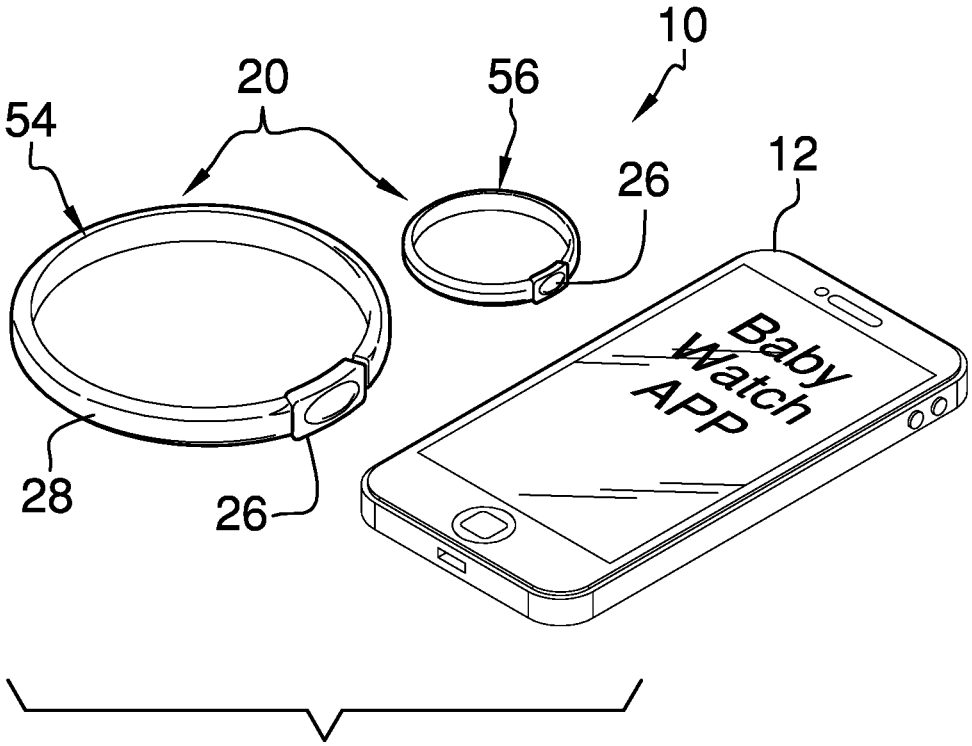
FIG. 1 is a perspective view of a child tracking system according to an embodiment of the disclosure.
Figure 2:
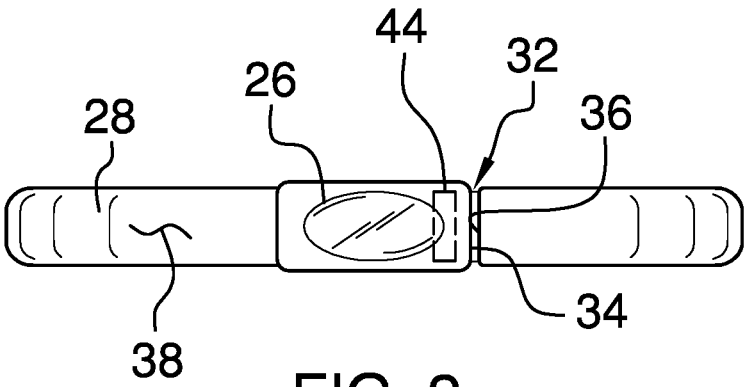
FIG. 2 is a front view of a tracking unit of an embodiment of the disclosure.
Figure 3:
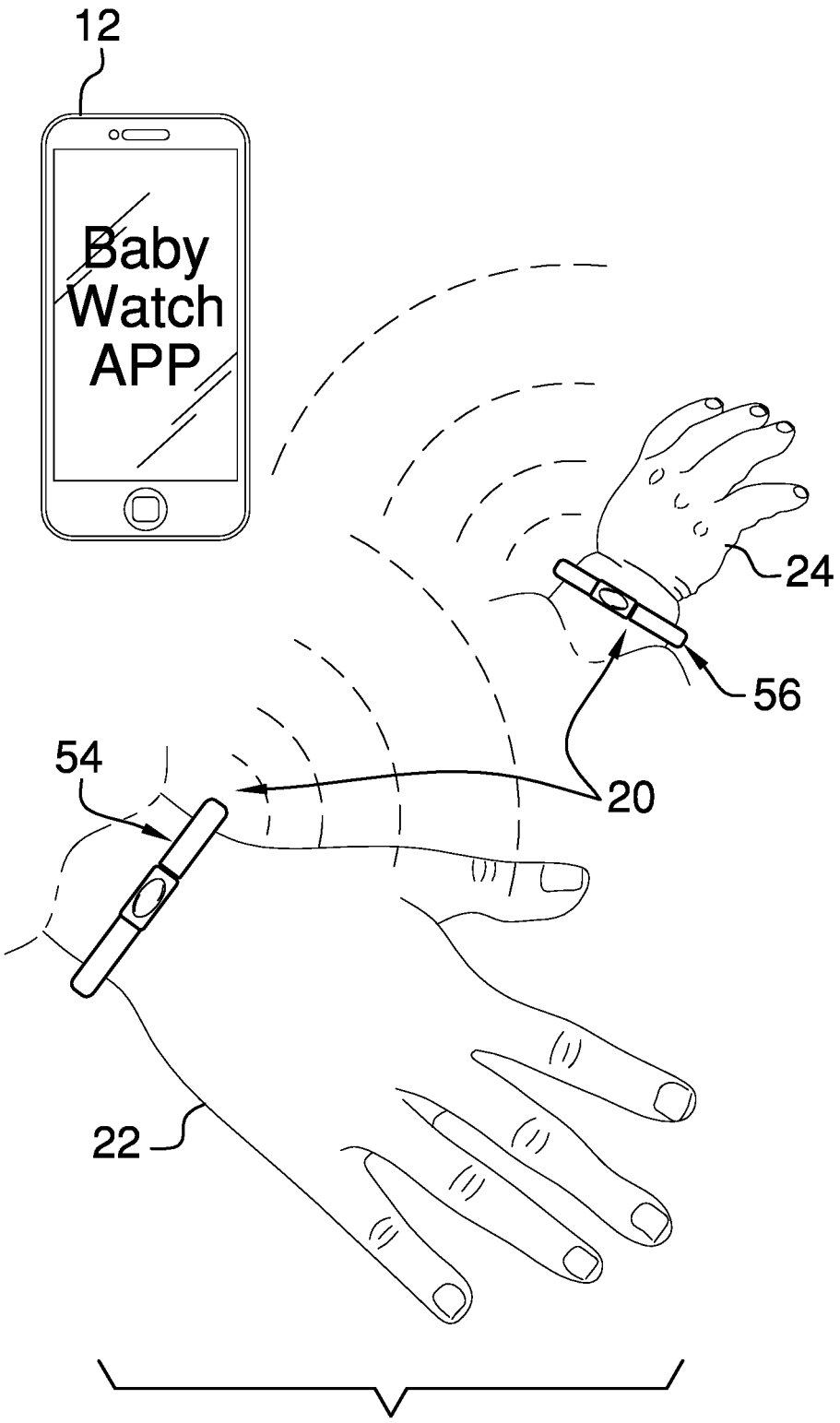
FIG. 3 is a perspective in-use view of an embodiment of the disclosure.
Figure 4:
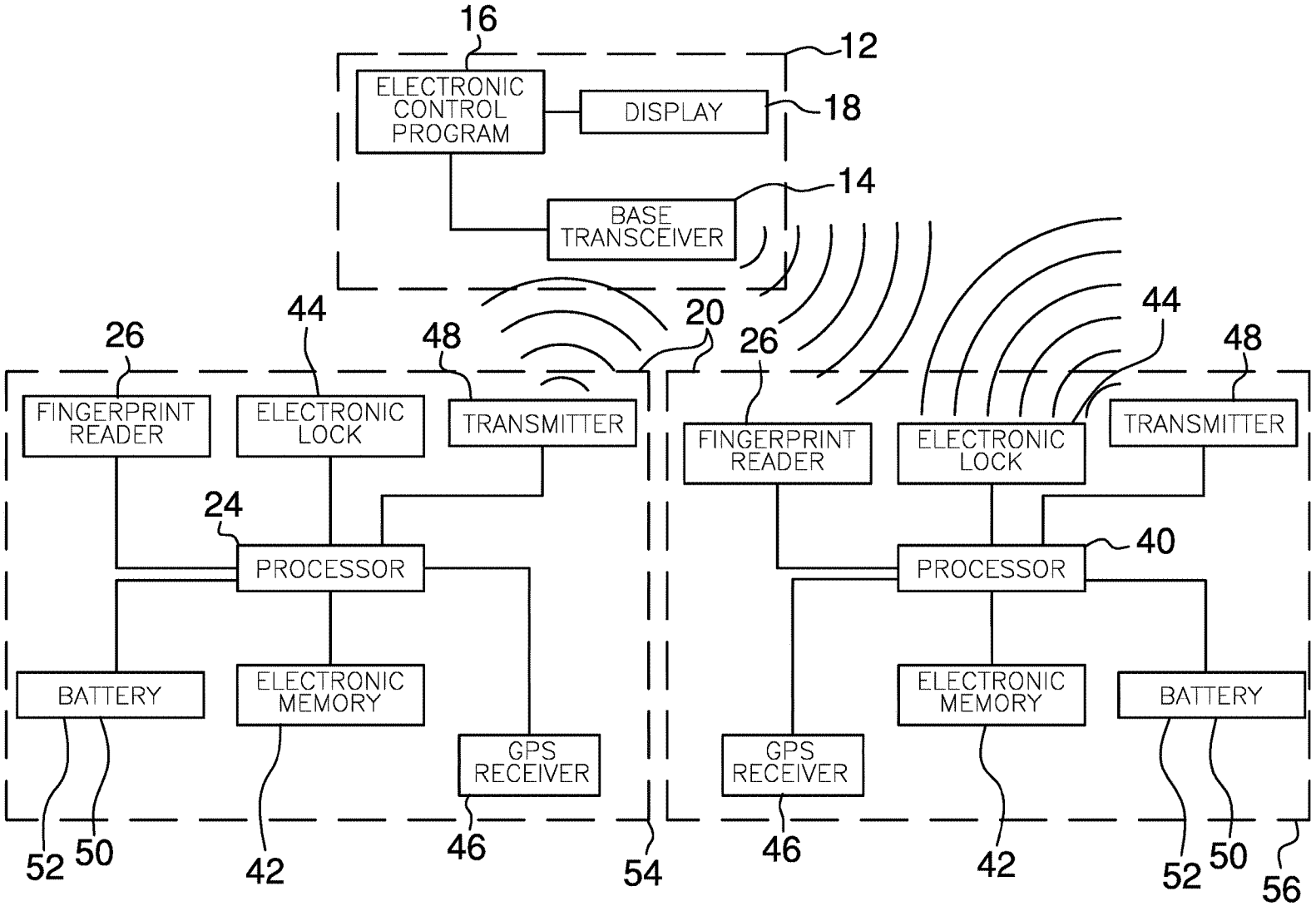
FIG. 4 is a schematic view of an embodiment of the disclosure.

With reference now to the drawings, and in particular to FIGS. 1 through 4 thereof, a new tracking device embodying the principles and concepts of an embodiment of the disclosure and generally designated by the reference numeral 10 will be described.

As best illustrated in FIGS. 1 through 4, the child tracking system 10 generally comprises an electronic device 12 that may be manipulated. The electronic device 12 may comprise a smart phone or the like. The electronic device 12 has a base transceiver 14. The electronic device 12 may store an electronic control program 16. The electronic control program 16 may comprise a smart phone app or the like.

The electronic control program 16 is manipulated to establish a trigger distance. The trigger distance may be a distance ranging between approximately five meters and thirty meters. The electronic device 12 includes a display 18. The display 18 may comprise an electronic display or the like. The electronic device 12 selectively emits an audible alarm.

A pair of tracking units 20 is provided. Each of the tracking units 20 may be worn by an associated one of an adult 22 and a child 24. Each of the tracking units 20 are in communication with a global positioning satellite. Thus, a physical location corresponding to each of the tracking units 20 may be identified.

Each of the tracking units 20 is in electrical communication with the electronic device 12. Thus, the display 18 may display the physical location corresponding to each of the tracking units 20. Each of the tracking units 20 has a fingerprint reader 26 and the fingerprint reader 26 may read fingerprints. The fingerprint reader 26 corresponding to each of the tracking units 20 may comprise an electronic fingerprint reader 26 or the like.

Each of the tracking units 20 comprises a bracelet 28 that may be worn on a wrist 30. Alternatively, each of tracking units 20 may comprise a necklace that may be worn around a neck. The bracelet 28 has a cut 32 defining a first end 34 and a second end 36 of the bracelet 28. The first end 34 is matable to the second end 36 and the bracelet 28 has an outwardly facing surface 38.

A processor 40 is positioned within the bracelet 28 and the processor 40 selectively generates an unlock sequence. The processor 40 may comprise an electronic processor 40 or the like. An electronic memory 42 is positioned within the bracelet 28 and the electronic memory 42 is electrically coupled to the processor 40. The electronic memory 42 may store a pass code for an authorized user. The pass code may be a fingerprint of the authorized user or the like.

The fingerprint reader 26 is positioned on the outwardly facing surface 38 and the fingerprint reader 26 may be manipulated. Thus, the fingerprint reader 26 may read a fingerprint. The fingerprint reader 26 is electrically coupled to the processor 40. The processor 40 may compare the fingerprint to the pass code in the electronic memory 42. The processor 40 generates the unlock sequence when the fingerprint matches the pass code.

An electronic lock 44 is coupled to the first end 34 of the bracelet 28 and the electronic lock 44 is electrically coupled to the processor 40. The electronic lock 44 selectively engages the second end 36 of the bracelet 28. Thus, the electronic lock 44 may retain the bracelet 28 on the wrist 30. The electronic lock 44 disengages from the second end 36 when the processor 40 generates the unlock sequence. Thus, the bracelet 28 may be removed from the wrist 30.

A gps receiver 46 is positioned within the bracelet 28. The gps receiver 46 may be in electrical communication with the global positioning satellite. The gps receiver 46 is electrically coupled to the processor 40. The gps receiver 46 may comprise a radio frequency receiver or the like.

A transmitter 48 is positioned within the bracelet 28 and the transmitter 48 is electrically coupled to the processor 40. The transmitter 48 is in electrical communication with the base transceiver 14. Thus, the transmitter 48 may communicate the physical location of the bracelet 28 to the electronic device. The transmitter 48 may comprise a radio frequency transmitter 48 or the like.

A power supply 50 is provided. The power supply 50 is positioned within the bracelet 28. The power supply 50 is electrically coupled to the processor 40. The power supply 50 comprises at least one battery 52.

The pair of tracking units 20 includes an adult tracking unit 54 and a child tracking unit 56. The adult tracking unit 54 may be worn by the adult 22 and the child tracking unit 56 may be worn by the child 24. The electronic device 12 emits the audible alarm when the child tracking unit 56 moves beyond the trigger distance from the adult tracking unit 54. Thus, the electronic device 12 may alert the adult 22 that the child 24 has moved beyond the trigger distance from the adult 22. A plurality of the child tracking units 56 may be provided. Each of the plurality of child tracking units 56 may be worn by an associated one of a plurality of children.

In use, the adult 22 wears the adult tracking unit 54 and the child 24 wears the child tracking unit 56. Each of the tracking units 20 are worn when the adult 22 and the child 24 are in a populated, public area. The electronic control program 16 is manipulated to establish the trigger distance. The display 18 on the electronic device 12 constantly displays the physical location of the adult tracking unit 54 and the child tracking unit 56. The electronic device 12 emits the audible alarm when the child tracking unit 56 moves beyond the trigger distance from the adult tracking unit 54. The adult 22 views the display 18 to track the child 24 when the child 24 moves beyond trigger distance. The fingerprint reader 26 corresponding to each of the tracking units 20 is manipulated to remove the corresponding tracking unit 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A child tracking system comprising:

an electronic device being configured to be manipulated, said electronic device having a base transceiver, said electronic device being configured to store an electronic control program, said electronic device selectively determining a trigger distance, said electronic device including a display, said electronic device selectively emitting an audible alarm;

a pair of tracking units, each of said tracking units being configured to be worn by an associated one of a adult and a child, each of said tracking units being configured to be in communication with a global positioning satellite thereby facilitating a physical location corresponding to each of said tracking units to be identified, each of said tracking units being in electrical communication with said electronic device wherein said display is configured to display the physical location corresponding to each of said tracking units, each of said tracking units having a fingerprint reader wherein fingerprint reader is configured to read fingerprints, each of said tracking units comprising:

a bracelet being configured to be worn on a wrist, said bracelet having a cut defining a first end and a second end of said bracelet, said first end being matable to said second end, said bracelet having an outwardly facing surface, a processor being positioned within said bracelet, said processor selectively generating an unlock sequence, an electronic memory being positioned within said bracelet, said electronic memory being electrically coupled to said processor, said electronic memory being configured to store a pass code for an authorized user, said fingerprint reader being positioned on said outwardly facing surface wherein said fingerprint reader is configured to be manipulated thereby facilitating said fingerprint reader to read a fingerprint, said fingerprint reader being electrically coupled to said processor wherein said processor is configured to compare the fingerprint to the pass code in said electronic memory, said processor generating said unlock sequence when the fingerprint matches the pass code, an electronic lock being coupled to said first end of said bracelet, said electronic lock being electrically coupled to said processor, said electronic lock selectively engaging said second end of said bracelet wherein said electronic lock is configured to retain said bracelet on the wrist, said electronic lock disengaging from said second end when said processor generates said unlock sequence wherein said bracelet is configured to be removed from the wrist, a gps receiver being positioned within said bracelet, said gps receiver configured to be in electrical communication with the global positioning satellite, said gps receiver being electrically coupled to said processor, a transmitter being positioned within said bracelet, said transmitter being electrically coupled to said processor, said transmitter being in electrical communication with said base transceiver wherein said transmitter is configured to communicate the physical location of said bracelet to said electronic device, and a power supply, said power supply being positioned within said bracelet, said power supply being electrically coupled to said processor, said power supply comprising at least one battery; and said pair of tracking units including an adult tracking unit and a child tracking unit, said adult tracking unit being configured to be worn by an adult, said child tracking unit being configured to be worn by a child, said electronic device emitting said audible alarm when said child tracking unit moves beyond said trigger distance from said adult tracking unit wherein said electronic device is configured to alert the adult that the child has moved beyond said trigger distance from the adult.

* * * * *